United States Patent [19]

Taylor

[11] 4,192,369

[45] Mar. 11, 1980

[54] ADJUSTABLE DECORATIVE SHUTTER

[75] Inventor: Ian D. Taylor, Beaconsfield, Canada

[73] Assignee: Hunter Douglas International N.V., ANX

[21] Appl. No.: 771,098

[22] Filed: Feb. 23, 1977

[30] Foreign Application Priority Data

Jan. 26, 1977 [CA] Canada ..... 270496

[51] Int. Cl.[2] ..... E06B 7/08

[52] U.S. Cl. ..... 160/223; 52/473

[58] Field of Search ..... 160/223; 52/311, 314, 52/473, 459–465, 632

[56] References Cited

U.S. PATENT DOCUMENTS

| | | | |
|---|---|---|---|
| 2,210,516 | 8/1940 | Wheeler | 160/223 |
| 2,496,921 | 2/1950 | Vicksell, Sr. | 160/223 |
| 2,580,268 | 12/1951 | Archer et al. | 160/223 |
| 3,120,883 | 2/1964 | Greiling | 52/473 |
| 3,628,298 | 12/1971 | Sickler | 52/473 |

*Primary Examiner*—Peter M. Caun

*Attorney, Agent, or Firm*—Pennie & Edmonds

[57] ABSTRACT

An adjustable length decorative shutter is shown which can be varied in height to fit a variety of window heights. The shutter includes a series of spaced parallel panel assemblies, each of which includes a main panel member and an end panel member mounted to each of the opposing ends of the main panel member in telescoped mating relation therewith to thus provide adjustability in the length of the panel assemblies. Connector members serve to secure the respective groups of end panel members together, such connector members being arranged to conceal the inner end parts of the end panel members to impart a unitary appearance to each of the panel assemblies.

3 Claims, 7 Drawing Figures

ADJUSTABLE DECORATIVE SHUTTER

This invention relates to improvements in shutters, particularly to shutters which are to be used primarily for decorative purposes. More particularly, this invention relates to an adjustable length shutter which can be readily varied in length to fit a variety of window heights.

A frequent problem for consumers in the past has been the unsightliness of decorative shutters which are too long or too short for the window with which they are used. Since it is impractical to cut the average shutter to the correct length at the job site, suppliers have had to maintain in stock a very large variety of shutter lengths (previously, up to approximately twenty different lengths) to satisfy the varied needs of their customers. Obviously, this led to increased costs for manufacturers, distributers and dealers which costs, in the end, had to be passed on to the consumer.

Accordingly, one object of the invention is to provide an adjustable length shutter of simple construction, employing a minimum number of components, and enabling supply inventories to be kept to a minimum.

A further object is to provide a decorative shutter which can be readily custom sized on the job site for the particular application without the use of special tools, thus reducing installation costs and enabling the shutters to be installed without the need for skilled personnel.

A further object is to provide a decorative shutter arranged such that the regions or areas of adjustment are concealed, in the installed condition of the shutter, thus providing for an attractive, unitary appearance of the shutters.

A still further object of the invention is to provide an adjustable decorative shutter which does not require the use of a peripheral or marginal frame, and which shutter is so arranged that relative movement of the several panels making up the shutter is not possible after the shutter has been properly secured in place i.e. there is no possibility of one or more of the panel members moving out of position some time after installation and spoiling the appearance of the decorative shutter.

The prior art has provided a variety of adjustable shutter arrangements, reference being had to U.S. Pat. No. 3,120,883 of Feb. 11, 1964 to Greiling, U.S. Pat. No. 3,191,242 of June 29, 1965 to Rauen and, more recently, U.S. Pat. No. 3,932,959 of Jan. 20, 1976 to Jansons et al. However, it is considered that the various prior art adjustable shutter designs have not been fully successful in satisfying all of the objectives noted above.

Thus, in accordance with the invention, in one aspect there is provided a decorative shutter comprising: a plurality of parallel elongated panel assemblies; each panel assembly including at least a main panel member and an end panel member mounted on an end portion of the main panel member, each end panel member having an inner end, and an outer end directed outwardly and away from the main panel member; each of the panel members having opposed longitudinal edge portions shaped such as to retain said end panel members on said end portions of the main panel member and in telescoping mating relation therewith such as to allow said end panel members to be slid to and fro relative to their associated main panel members in a direction parallel to said opposed longitudinal edge portions; means for retaining said panel assemblies in said parallel relationship including connector member extending transversely of said panel assemblies and connected to each of said end panel members to enable said end panel members to be slid to and fro as a group relative to their associated main panel members thereby to effect variations in the overall length of the shutter; and wherein said connector member is secured to its associated end panel members closely adjacent the inner end portions thereof and in overlapping relation thereto such that said connector member conceals such inner end portions from view and thus imparts a unitary appearance to each of the panel assemblies of the shutter.

In accordance with the invention in a further aspect, there is provided a decorative shutter comprising: a plurality of spaced parallel elongated panel assemblies; each panel assembly including an intermediate panel member and a first and a second end panel member mounted on respective opposing end portions of the intermediate panel member, each end panel member having an inner end, and an outer end directed outwardly and away from the intermediate panel; each of the panel members having opposed longitudinal edge portions shaped such as to retain said end panel members on said opposing end portions of the intermediate panel member and in telescoping mating relation therewith such as to allow said end panel members to be slid to and fro relative to their associated intermediate panel members in a direction parallel to said opposed longitudinal edge portions; means for retaining said panel assemblies in said spaced parallel relationship including a first connector member extending transversely of said panel assemblies and connected to each of said first end panel members and a second connector member extending transversely of said panel assemblies and connected to each of said second end panel members whereby said first or second end panel members may be slid to and fro as a group relative to their associated intermediate panel members thereby to effect variations in the overall length of the shutter; and wherein said first and second connector members are secured to their associated end panel members closely adjacent the inner end portions of each and in overlapping relation thereto such that each connector member conceals such inner end portions from view and thus imparts a unitary appearance to each of the panel assemblies of the shutter.

In a still further aspect of the invention each panel member is made of sheet metal and has a major frontal surface and a back surface with said longitudinal edge portions of each panel member being bent or curled inwardly in directions away from said major frontal surface with the longitudinal edge portions of the end panel members closely embracing the longitudinal edge portions of their associated intermediate panel member.

In accordance with a further aspect of the invention each said connector member comprises a generally rigid strip of sheet material overlying portions of the major frontal surfaces of the associated end panel members at the inner end portions thereof, and spaced apart connector means associated therewith to provide the connection to the end panel members associated therewith.

In a still further aspect of the invention the edges of each panel member at the opposing ends thereof are convexly curved outwardly.

A preferred embodiment of the invention will now be described by way of example with reference to the drawings wherein.

Figure 1:
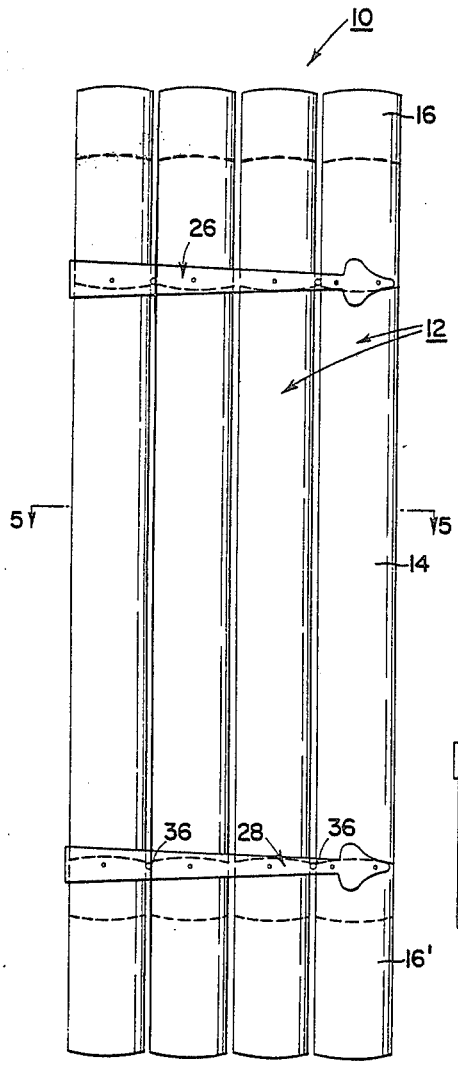
FIG. 1 is a frontal view of the decorative shutter in the fully assembled, extended condition.
Figure 3:
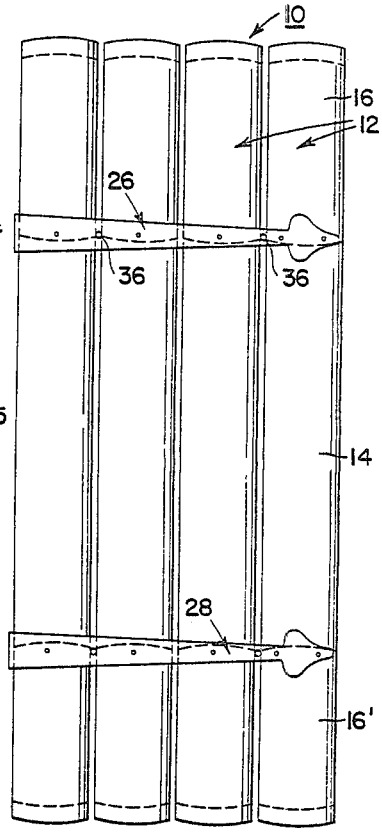
FIG. 3 is a view similar to that of FIG. 1 but wherein the decorative shutter is shown in an almost fully contracted or shortened condition.
Figure 2:
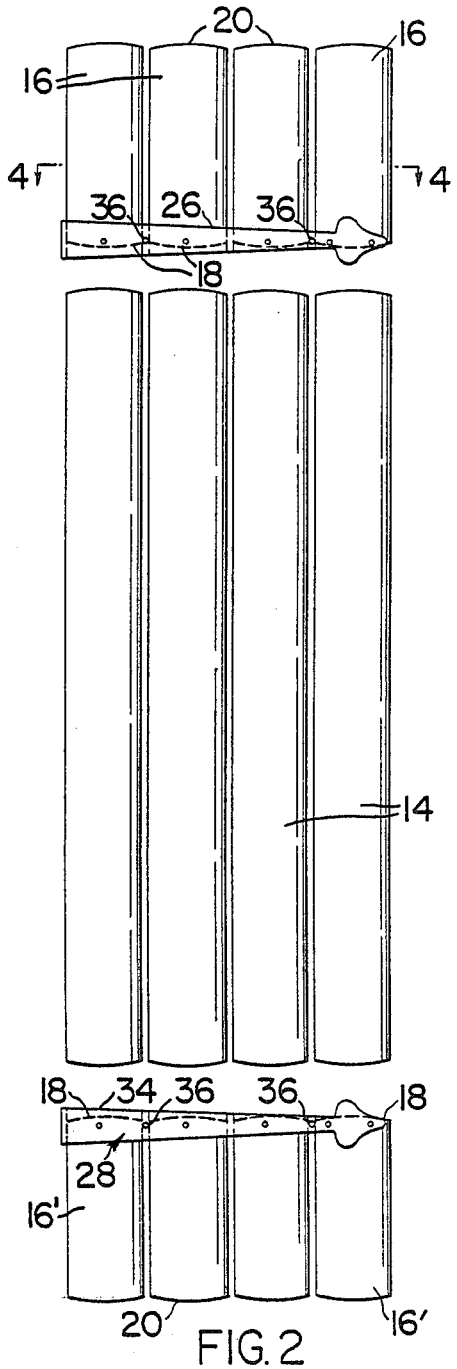
FIG. 2 is a view similar to that of FIG. 1 but wherein the end panel member assemblies are shown as being separated from the intermediate panel members.

With reference now to the drawings, it will be seen that the decorative shutter 10 comprises a plurality of spaced parallel elongated panel assemblies 12. With reference to FIGS. 1, 2 and 3 it will be seen that each panel assembly 12 includes a relatively elongated intermediate panel member 14 and first and second end panel members 16,16' arranged to be mounted on respective opposing end portions of the intermediate panel member 14. Each end panel member 16, 16' includes an inner end 18 and an outer end 20 directed outwardly and away from the intermediate panel 14.

Figure 4:
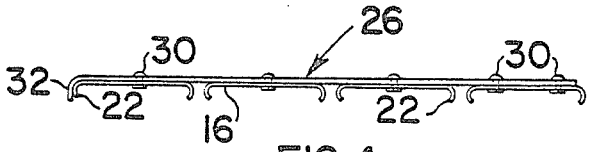
FIG. 4 is a section view taken along section line 4—4 of FIG. 2.
Figure 5:
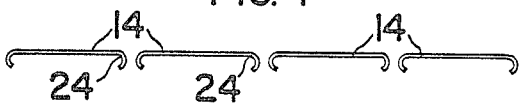
FIG. 5 is a section view taken along section line 5—5 of FIG. 1.

With particular reference to FIGS. 4 and 5, each panel member 14, 16, 16' is made of sheet metal, preferably sheet aluminum having a durable decorative finish on the surfaces thereof which are exposed to view, which finish may be of any desired colour. It will be seen from FIGS. 4 and 5 that the longitudinal edge portions 22 of each of the end panel members 16, 16' and the longitudinal edge portions 24 of the intermediate panel members 14 are curled inwardly in a generally shallow C-shape configuration in directions away from the major frontal surfaces (i.e. the surfaces which are exposed to view in the installed condition of the shutter). These curled longitudinal edge portions may be readily provided by roll-forming aluminum strip material in a manner well known in the art. By arranging for the longitudinal edge portions 22 and 24 of the end panel members and the intermediate panel members to be shaped as described above, the end panel members 16, 16' may be securely positioned on and retained on the opposing end portions of the intermediate panel members 14 and in telescoping mating relation therewith such as to allow the end panel members 16, 16' to be slid to and fro relative to their associated intermediate panel members 14 in a direction parallel to the opposed longitudinal edge portions 22, 24 as described above.

The decorative shutter further includes means for retaining the panel assemblies 12 in the above noted spaced parallel relationship. These means, as clearly shown on the drawings, include a first connector member 26 extending transversely of the panel assemblies 14 and connected to each of the end panel members 16. In addition, a second connector member 28 also extends transversely of the panel assemblies 14 and is connected to each of the second group of end panel members 16'. By virtue of this arrangement, the first or second sets of end panel members 16,16' may be slid to and fro as a group of unit relative to their associated intermediate panel members 14 thereby to effect variations in the overall length of the decorative shutter 10. Each connector member comprises a generally rigid strip of sheet material, preferably heavy gauge aluminum strip, which strip overlies the inner end portions 18 of the associated end panel members as illustrated in FIGS. 2 and 4. Suitable connector elements 30, such as rust resistant rivets extend through each of the connector members 26, 28, in spaced apart relation thereby to firmly secure the respective end panel members 16, 16' to their associated connector members 26, 28 respectively. In order to impart the necessary stability to the assembly, i.e. to prevent it from skewing out of shape, at least one of the end panel members 16, 16' should be secured to the connector member associated therewith by a spaced apart pair of connector elements 30 as shown for example in FIG. 4. In addition, one end of each strap connector member is preferably bent around its associated end panel member 16, 16' as shown at 32 in FIG. 4; this further serves to stabilize the structure against undesirable skewing out of shape prior to assembly and prior to installation on a building structure as well as contributing to the overall appearance of the assembly.

As shown in the drawings, the connector members 26 and 28 are contoured at their marginal edges thereby to provide them with an attractive appearance. In the embodiment shown in the drawings, the connector members 26 and 28 have the configuration of a colonial-style strap hinge. Obviously, other configurations may be used depending upon the tastes of the customer.

It is important to note that the above noted connector members 26 and 28 are secured to their associated end panel members 16, 16' closely adjacent the inner end portions 18 of each and in overlapping relationship thereto such that each connector member 26 and 28 conceals such inner end portions 18 from view and thus imparts a unitary appearance to each of the panel assemblies 12 of the shutter. With reference to FIG. 2 it will be seen that the marginal edge portion 34 of connector member 28 extends beyond the extreme end edge portions 18 of the end panel members 16'. The same condition prevails in connection with the other connector member 26. Thus, with the extreme inner end portions 18 of the end panel members 16, 16' effectively concealed from view by the connector members 26 and 28, the casual observer of the decorative shutter in the fully assembled condition is given the impression that each of the panel assemblies 12 are of a unitary construction.

In order to provide for securement of the shutter assembly to the wall of a building structure, each of the connector members 26, 28 is provided with a spaced apart pair of apertures 36 through which suitable fasteners may be inserted.

It will be also noted here that the edges at the extreme outer ends of both the intermediate panel members 14 and the end panel members 16, 16' are convexly curved outwardly. This curvature is provided not only for decorative purposes but also serves a practical purpose as well. By providing for such shallow convex curvature, insertion of the intermediate panel members 14 into the above noted telescoping mating relationship with the associated end panel members 16, 16' is facilitated. If the end portions of the panel members which are to be brought together are simply cut square across, it is somewhat more difficult to insert the intermediate panel members 14 into the end panel members as the edges tend to "hang up" on one another thus requiring somewhat more time and effort on the part of the persons effecting the assembly. The use of the convexly curved edges, as shown in the drawings, assists in overcoming this problem.

Figure 7:
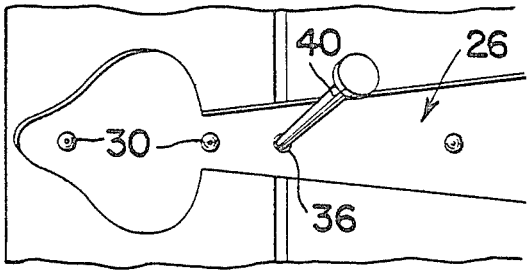
FIGS. 6 and 7 are views of portions of the shutter assembly illustrating certain steps in the installation procedure.
Figure 6:
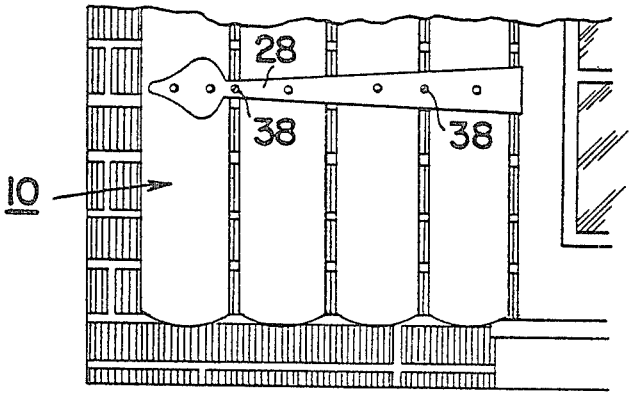

As noted previously, installation of the decorative shutters is a relatively simple matter. Installation can be effected without the use of any special tools and the required installation time is relatively short, even for a relatively inexperienced person. The shutters will ordinarily be shipped to the job site in the assemblied condition and the person effecting the installation will readily be able to adjust the length of the shutter to suit the height of the window beside which the shutters will be installed. With reference to FIG. 6, the shutter, which has been adjusted to the correct length, is placed in position beside the window and in the case of a building having wooden walls, the fasteners 38, comprising rust-proof screws or nails are positioned in the apertures 36 provided in the connector members 26 and 28 and driven into the wall thereby making a secure connection. The holes or apertures 38 can be positioned so that the fasteners 38 will pierce the intermediate panel members 14 thus making relative movement between the latter and the end panel members impossible after installation has been completed. In the case of buildings having brick, stone or stucco walls, the wall is marked for drilling by inserting a thin sharp object 40 through the screw holes or apertures 36 as shown in FIG. 7. The wall is then drilled at the required locations and suitable screw anchors inserted following which the shutter assembly is placed in position and the required screws inserted and tightened up in the usual fashion.

A specific embodiment of the invention has been described by way of example. However, those skilled in the art will realize that numerous modifications and variations may be made within the scope or spirit of the invention, the invention being defined in the claims appended hereto. For example, as shown in the drawings, the panels are spaced apart, but they could be positioned in direct contact with one another; alternatively the gaps between the panels could be filled with small elongated profile strips inserted in the spaces between the panels.

I claim:

1. A decorative shutter comprising:

(a) a plurality of parallel elongated panel assemblies;

(b) each panel assembly including a main panel member and an end panel member mounted on at least one end portion of the main panel member, each end panel member having an inner end, and an outer end directed outwardly and away from the main panel member;

(c) each of the panel members having opposed longitudinal edge portions shaped such as to retain said end panel members on said end portions of the main panel member and in telescoping mating relation therewith such as to allow said end panel members to be slid to and fro relative to their associated main panel members in a direction parallel to said opposed longitudinal edge portions;

(d) means for retaining said panel assemblies in said parallel relationship including a connector member extending transversely of said panel assemblies and connected to each of the end panel members situated at one end of said main panel members to enable said end panel members to be slid to and fro as a group relative to their associated main panel members thereby to effect variations in the overall length of the shutter;

(e) and wherein said connector member is a rigid member secured to all its associated end panel members in overlapping relation to the inner edges of the inner end portions of the end panel members such that said connector members conceals such inner edges from view and thus imparts a unitary appearance to each of the panel assemblies of the shutter;

(f) wherein each panel member has a major frontal surface and a back surface with said longitudinal edge portions of each panel member being curved inwardly toward each other in directions away from said major frontal surface and the longitudinal edge portions of the end panel members closely embrace the longitudinal edge portions of their associated main panel member; and (g) the outer ends of said end panel members being free of any connection with any adjacent outer ends of end panel members.

2. The decorative shutter of claim 1 in which there are two such end panel members mounted on the opposite end portions of the main panel member.

3. The decorative shutter of claim 1 in which the outer ends of said end panel members are free of any connection with any adjacent outer ends of end panel members.

* * * * *

UNITED STATES PATENT AND TRADEMARK OFFICE

CERTIFICATE OF CORRECTION

PATENT NO. : 4,192,369

DATED : March 11, 1980

INVENTOR(S) : Ian D. Taylor

It is certified that error appears in the above-identified patent and that said Letters Patent are hereby corrected as shown below:

In the masthead of the patent under the name of the Assignee the letters ANX should be replaced by:

"Netherlands Antilles"

Column 3, line 62, the word "of" should read "or"

Column 5, line 3, "assemblied" should read "assembled"

Signed and Sealed this

*Twenty-sixth* Day of *August 1980*

[SEAL]

*Attest:*

SIDNEY A. DIAMOND

*Attesting Officer*

*Commissioner of Patents and Trademarks*